US007146833B2

(12) United States Patent
Ramsauer

(10) Patent No.: US 7,146,833 B2
(45) Date of Patent: Dec. 12, 2006

(54) CLOSING CYLINDER

(76) Inventor: Dieter Ramsauer, Max-Klein-Strasse 10, D-58332 Schwelm (DE)

( * ) Notice: Subject to any disclaimer, the term of this patent is extended or adjusted under 35 U.S.C. 154(b) by 0 days.

(21) Appl. No.: 10/415,033

(22) PCT Filed: Sep. 22, 2001

(86) PCT No.: PCT/EP01/10969

§ 371 (c)(1),
(2), (4) Date: Apr. 22, 2003

(87) PCT Pub. No.: WO02/35035

PCT Pub. Date: May 2, 2002

(65) Prior Publication Data

US 2004/0020251 A1 Feb. 5, 2004

(30) Foreign Application Priority Data

Oct. 25, 2000 (DE) ..... 200 18 281 U

(51) Int. Cl.
*E05B 17/04* (2006.01)

(52) U.S. Cl. ..... 70/379 R; 70/367; 70/371; 70/375

(58) Field of Classification Search ..... 70/208, 70/210, 367–375, 379 R, 380, DIG. 30; 292/DIG. 38
See application file for complete search history.

(56) References Cited

U.S. PATENT DOCUMENTS 1,564,463 A 12/1925 Best
1,692,826 A * 11/1928 Ganz ..... 70/231
2,036,764 A * 4/1936 Lowe ..... 70/369
2,042,025 A * 5/1936 Schlage ..... 70/379 R
2,837,908 A * 6/1958 Segal ..... 70/367
3,919,866 A * 11/1975 Lipschutz ..... 70/81
4,099,397 A * 7/1978 Dauenbaugh ..... 70/371
4,211,097 A * 7/1980 Martikainen et al. ..... 70/373
4,228,669 A * 10/1980 Bischoff ..... 70/379 R
4,550,580 A * 11/1985 Neyret ..... 70/370
4,672,828 A * 6/1987 Theriault ..... 70/373
4,761,978 A * 8/1988 Walla ..... 70/367
4,899,563 A * 2/1990 Martin ..... 70/367
4,926,670 A * 5/1990 Deforrest, Sr. ..... 70/374
5,044,183 A * 9/1991 Neyret ..... 70/223
5,440,905 A 8/1995 Yamada
5,450,737 A * 9/1995 Sasaki ..... 70/346
5,606,882 A * 3/1997 Larsen et al. ..... 70/369
5,630,332 A * 5/1997 Aldieri et al. ..... 70/379 R
5,884,512 A 3/1999 Wayne
5,907,963 A * 6/1999 Myers et al. ..... 70/371
5,931,035 A * 8/1999 Bolton ..... 70/367
6,012,311 A * 1/2000 Duckwall ..... 70/369

(Continued)

FOREIGN PATENT DOCUMENTS

DE 42 19 477 12/1996

(Continued)

*Primary Examiner*—Suzanne Dino Barrett
(74) *Attorney, Agent, or Firm*—Reed Smith LLP

(57) ABSTRACT

The description relates to a closing cylinder for closure devices comprising a cylindrical closing housing which can be received in a fixed manner in an opening formed by a handle, closure device or the like, a closing core (18) is rotatably mounted in this closing housing and is axially supported at one of its ends on the housing edge by an edge projection (20) and carries or forms a drive at its other end for a bolt or closure (124), wherein, according to the invention, the drive (124) is held at the end of the closing core (118) in a positive engagement so as to be exchangeable.

8 Claims, 9 Drawing Sheets

U.S. PATENT DOCUMENTS 6,041,627 A 3/2000 Buckland
6,089,059 A * 7/2000 Fan ..... 70/371
6,105,405 A 8/2000 Westwinkel
6,113,160 A * 9/2000 Johansson et al. ..... 292/169
6,185,966 B1 * 2/2001 Chen ..... 70/366
6,439,015 B1 * 8/2002 Sauerland et al. ..... 70/368
6,446,475 B1 * 9/2002 Agnatovech et al. ..... 70/379 R
6,668,602 B1 * 12/2003 Graham et al. ..... 70/208
6,722,171 B1 * 4/2004 Ruan ..... 70/379 R

FOREIGN PATENT DOCUMENTS

EP 0 350 474 1/1990
WO WO 99/46464 9/1999

* cited by examiner

CLOSING CYLINDER

CROSS-REFERENCE TO RELATED APPLICATIONS

This application claims priority of International Application No. PDT/EP01/10969, filed Sep. 22, 2001 German Application No. 200 18 281.1, filed Oct. 25, 2000, the complete disclosures of which are hereby incorporated by reference.

BACKGROUND OF THE INVENTION a) Field of the Invention

The invention is directed to a closing cylinder for closure devices comprising a cylindrical closing housing which can be received in a fixed manner in an opening formed by a handle, closure device or the like. A closing core is rotatably mounted in this closing housing and is axially supported at one of its ends on the edge of the closing housing by an edge projection. The edge projection and the housing edge can form means for limiting the rotational path of the closing core inside the housing, and the closing core carries or forms a drive at its other end for a bolt or closure.

b) Brief Description of the Related Art

A closing cylinder of the type mentioned above is already known, for example, from catalog sheet 1–053, DIRAK GmbH & Co. KG, Kaiserstr. 55–59, 58332 Schwelm, or from EP 0350474. FIG. 2 of the present application shows the basic operation of a closing cylinder of this type which will be described more fully in the following. It is disadvantageous in this prior art that a different cylinder core is required depending on the intended purpose, which means that relatively high inventory costs must be factored in.

OBJECT AND SUMMARY OF THE INVENTION

The primary object of the invention is to prevent these disadvantages.

The object is met in that the drive for a bolt or closure or the like is held at the end of the closing core in a positive engagement so as to be exchangeable. Accordingly, it is not necessary to stock various versions of the closing core in its entirety; rather, only different drives for bolts or closures that can be connected to the unchangeable closing cores must be stocked depending on the intended object. This lowers costs and also reduces the space requirement for a larger inventory.

In a particularly advantageous design according to a development of the invention, the closing core forms a radially extending, undercut groove in the end face of the other end, and a tongue which projects forward from the bolt or drive can be inserted laterally into this groove.

According to another development of the invention, a locking device is provided between the end face and the drive for a bolt or lock and locks in when the tongue is inserted into the groove when the work position is achieved.

In particular, this prevents difficulties during assembly or operation caused by separation of the tounge and groove during assembly.

For reasons of stability, it is advantageous when the tounge proceeds from a circular disk which contacts the end face of the closing core when the tongue is inserted into the groove.

In this case, it is advantageous when the locking device comprises projections and recesses which proceed respectively from the end face and from the surface of the circular disk facing toward the end face.

The circular disk can form or carry different drive devices or even a bolt. Accordingly, it is possible that a radially projecting tongue proceeds from the side of the circular disk remote of the core. This results in a simply constructed sash closure.

Alternatively, an axially projecting eccentric that can drive closures requiring an eccentric drive can also proceed from the side of the circular disk remote of the core.

Alternatively, an axially projecting shaft which is provided with an eccentric at its free end can also proceed from the side of the circular disk remote of the core.

A polygon such as a square can also proceed from the side of the circular disk remote of the core and a sash tongue could then be mounted thereon, for example.

Since the drive in the embodiment forms discussed above is enclosed by the closing housing after the closing core has been mounted, the bolt or drive can no longer move out of this laterally inserted position. In embodiment forms where this is not the case, a locking device can be provided between the end face and the drive for the bolt or closure; when the operating position is reached, this locking device snaps in when the spring slides into the groove and can accordingly hold the tongue in the groove.

BRIEF DESCRIPTION OF THE DRAWINGS

The invention will be described more fully in the following with reference to embodiment examples shown in the drawings.

DESCRIPTION OF THE PREFERRED EMBODIMENTS

Figure 1:
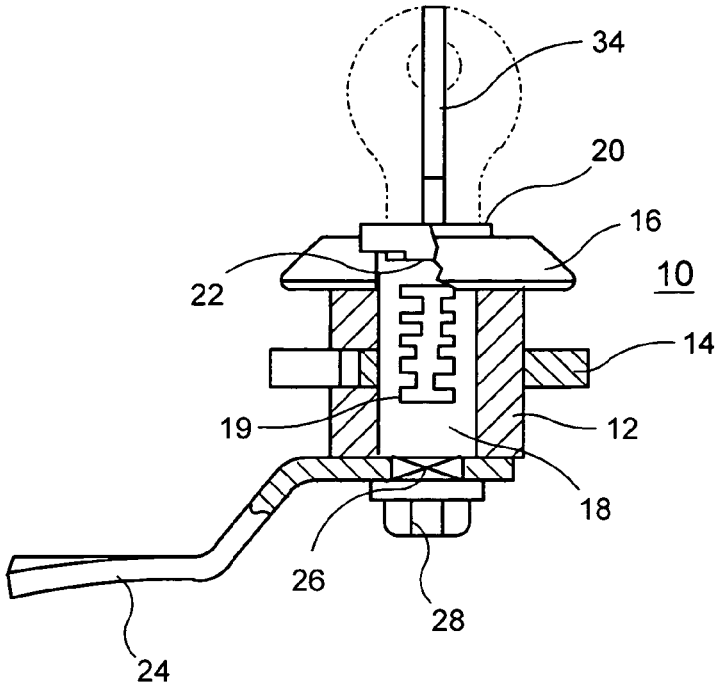
F I G. 1 PRIOR ART
FIG. 1 shows a closing cylinder of a conventional embodiment form installed in a sash closure.

FIG. 1 is a side view in partial axial section showing a closing cylinder 10 for closure devices, in this case a sash closure, comprising a cylindrical closing housing 12 which can be received so as to be fixed in an opening formed by a handle, closure device or the like, for example, in this case, in a switch cabinet door, wherein, for example, the door leaf is clamped between a key catch 16, formed by the housing 12, and a union nut 14 by tightening the nut. A closing core 18 is rotatably mounted in the closing housing 12. At one of its ends, the closing core 18 is axially supported by an edge projection 20, which is usually contoured, on the housing edge in the case of FIG. 1 in a countersink formed by the key catch 16. The contoured edge projection, e.g., in the form of a nose 22, and the housing edge form means for limiting the rotational path of the core 18 inside the housing 12. At the opposite end, the core forms a drive for a bolt 24 or some other closure, not shown. According to FIG. 1, the bolt 24 is held rigid against rotation on a square 26 proceeding from the core 18, the bolt 24 is prevented from sliding off the square 26, e.g., by a cap screw 28 which is screwed into a threaded bore hole arranged in the square or in the end face of the cylinder core 18.

Figure 2:
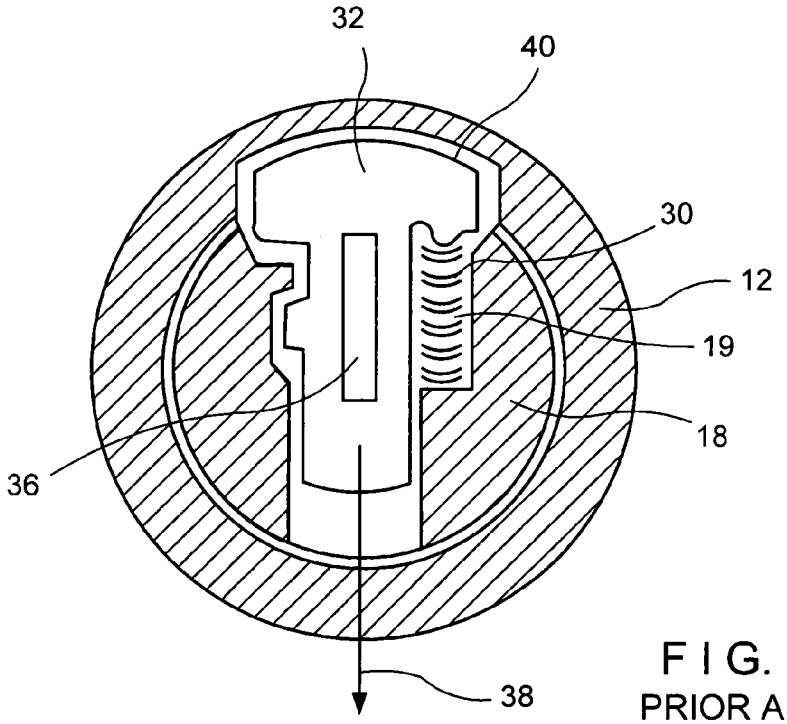
F I G. 2 PRIOR ART
FIG. 2 is a cross-sectional view showing the basic operation of a closing cylinder according to FIG. 1.

A plurality of blocking members 32, in this case five blocking members 32, which are acted upon by springs 30 are arranged next to one another in slots 19 inside the closing core 18 and prevent a rotation of the core 18 inside the housing 12 in the blocking position shown in FIG. 2. Only after the blocking members 32 are displaced against the spring force by means of a corresponding key 34 is it possible for the core 18 to rotate relative to the housing 12 because then, in conformity to its serration, the key 34 penetrating through the longitudinal slot 36 has pushed the individual blocking members 32 down in the direction of arrow 38 until the projecting part of the blocking member is released from the recess 40 of the housing. The closing core according to the prior art can be exchanged, e.g., by loosening the screw 28 and removing the bolt 24, whereupon the core 18 can be pulled out of the housing in the direction of the key catch 16 and replaced by another core which has a different shape at its end, for example.

Figure 3:
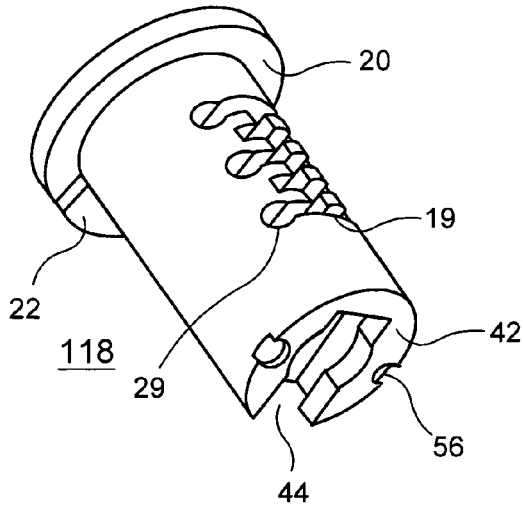
FIG. 3 is an enlarged perspective oblique bottom view of a closing cylinder constructed according to the invention.

In an embodiment form of a closing core 118 shown in FIG. 3, it is not necessary to exchange the entire closing core in order to use a drive adapted to a new task, for example, as is the case in the prior art according to EP 0 360 474 A3. Rather, in this case only the drive for the bolt or closure of the closing core is exchanged, which drive is held in the closing core in a positive engagement so as to be exchangeable. (In contrast, according to FIG. 1, the bolt 24 is exchangeable, but not the square 26 which holds the bolt so as to be secured by the cap screw 28. Therefore, the entire closing core must be changed in order to exchange the square drive for another one).

Figure 4A:
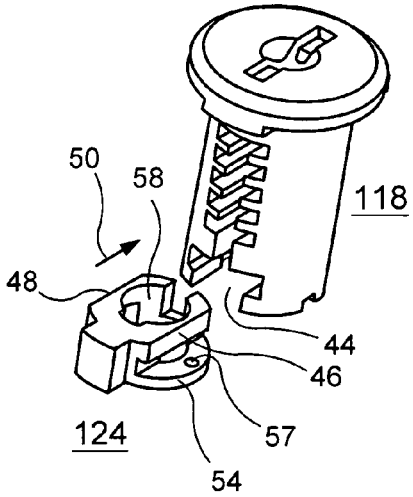
FIGS. 4A, 4B and 4C show the closing cylinder according to FIG. 3 in another enlarged perspective view during the process of insertion of the drive for a bolt device or closure device.
Figure 4B:
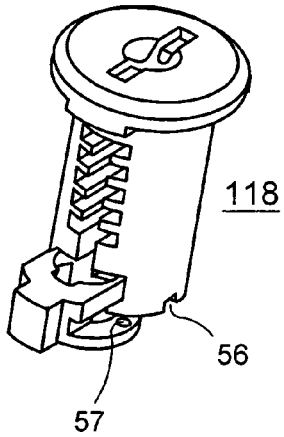
Figure 4C:
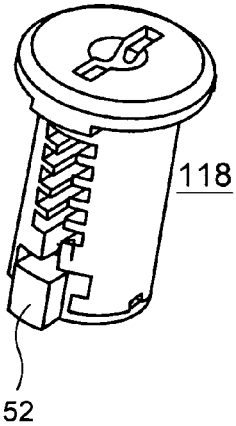
Figure 5A:
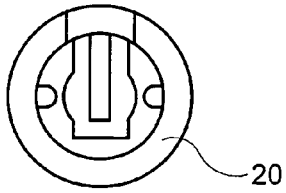
FIG. 5A is a rear view of the closing core according to FIG. 3.
Figure 5B:
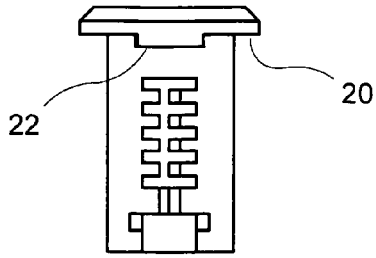
FIG. 5B shows a side view of the closing core according to FIG. 3.

According to FIGS. 4A, 4B and 4C, the closing core 118 forms a radially extending undercut groove 44 in the end face 42, a spring 46 and 48 which projects from the drive 124 and is adapted to the groove can be inserted laterally into this groove 44 (see arrow 50 and successive FIGS. 4A, 4B and 4C, where FIG. 4C shows the end position). This end state shows a closing core 118 which has a drive with a shoulder 52 which performs the function of a thumb in a closing system.

In order to hold the inserted bolt device 124 in position, either a press fit, that is, a frictional engagement, can be used or, better still, a positive engagement can be implemented, for example, in such a way that a locking device is provided between the end face 42 of the closing core 118 according to FIG. 3 and the drive 124, which locking device snaps in when the spring 46 or 48 slides into the groove 44 in the work position according to FIG. 4C. In a construction according to FIGS. 4A to 4C in which the tongue 46, 48 proceeds from a circular disk 54 which contacts the end face 42 of the closing core 118 when the spring is inserted into the groove, the locking device could be constructed in such a way that projections and recesses which are aligned with one another are arranged on the end face 42 or the surface of the circular disk 54 facing this end face 42. In the embodiment form shown in FIG. 3, recesses 56 are shown in the end face 42, while the circular disk 54 has projections 57.

Figure 7A:
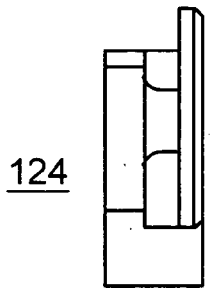
FIG. 7A shows a side view of an embodiment form of a drive for a thumb similar to the drive according to FIGS. 4A to 4C, which drive can be arranged on the closing core according to FIG. 3.
Figure 7B:
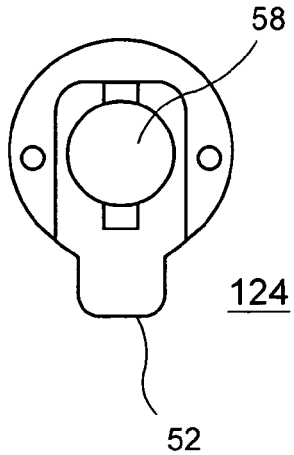
FIG. 7B shows a left-side view of the thumb drive according to FIG. 7A.
Figure 7C:
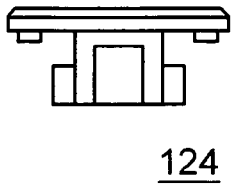
FIG. 7C shows a top view of the thumb drive according to FIG. 7B.

FIGS. 7A, 7B and 7C show the drive 124 of FIGS. 4A to 4D, specifically in a view from the right according to FIG. 4A, a top view according to FIG. 4A, a top view according to FIG. 4A, and a view from the left according to FIG. 4A and, therefore, three different views of the positive-locking drive for a thumb 52 are shown. The views in FIGS. 7A, 7B and 7C are shown approximately to scale, while the views in FIGS. 4A to 4C are shown in enlarged scale.

Closing cylinders of the type described are often fixed in a closure in such a way that a screw is screwed into the core from the rear. For this purpose, a round opening 58 is provided in the structural component part 24 through which a fastening screw of the type mentioned above can extend. For the sake of completeness only, it is noted that the lateral round bore holes 29 shown in FIG. 3 which open into slots 19 serve to receive the springs 30 and blocking members 32. For purposes of assembly, springs 30 are initially introduced into the round openings, three of which are shown in FIG. 3, and are then held by the blocking members 32 which are themselves initially held by an inserted key 34 and then by the housing 12.

Figure 6A:
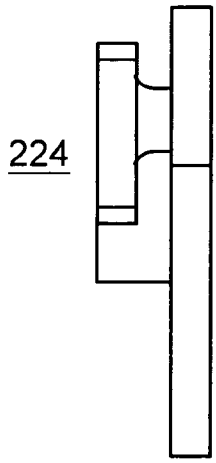
FIG. 6A shows a side view of an embodiment form of a drive for a bolt which can be arranged at the closing core according to FIG. 3.
Figure 6B:
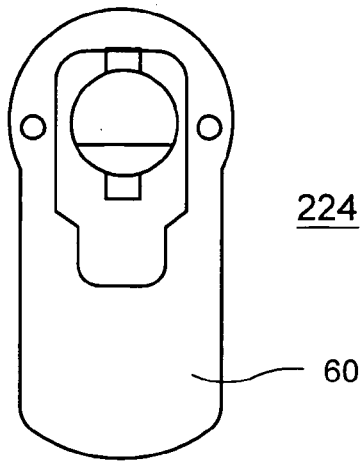
FIG. 6B shows a left-side view of the bolt drive according to FIG. 6A.

An embodiment form in which a bolt 60 extends radially outward from the drive 224 instead of a thumb 52 is shown in FIGS. 6A and 6B in a side view and a top view.

Due to the fact that the drives 124 and 224 project by their thumb 52 or bolt 60 over the circumferential contour of the portion of the core 118 that can be inserted into a receiving opening of an actuation lever or the like, as is also the case with the edge projection 20, the core 118 can be fixed axially in this receiving opening also through the insertion of the structural component part 124 or 224 into the undercut groove, so that a fastening screw, e.g., cap screw 28, according to FIG. 1 is not required. The thumb 52 or the bolt 60 then simultaneously performs the one task of axially securing the closing core in its receiving bore hole (which can always be given regardless of its rotational position when the device forming the receiving bore hole has the appropriate shape) and the other task of holding in a determined rotational position, e.g., a swivel lever in its swiveled in position in that a part of the thumb or bolt engages behind a fixed contact face.

The structural component part 124 or 224 can be made of metal or plastic. Plastic would make it possible for the closing core 118 which is usually metallic for purposes of stability to be electrically insulated on its back, especially since the whole circular profile of the core is covered by the circular disk 54. It is advantageous when the swivel lever or the like which forms the receptacle for the core is likewise made of an electrically insulating material. In this case, when used in electric switch installations and there are loose wires which carry voltage and contact the structural component part 124, this potentially dangerous voltage is not transferred to the housing 118 and, as the case may be, to an inserted key.

Figure 8A:
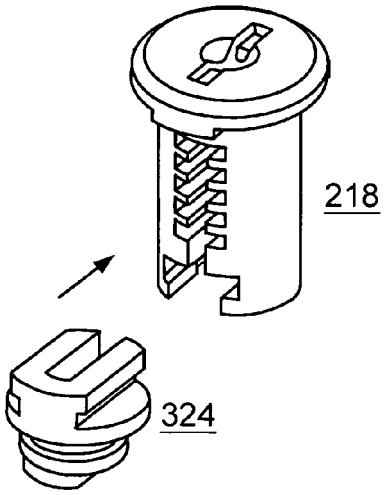
FIGS. 8A, 8B and 8C show perspective views of another embodiment form of a closing core constructed according to the invention during the mounting of a drive for an eccentric.
Figure 8B:
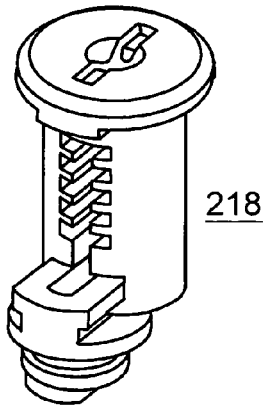
Figure 8C:
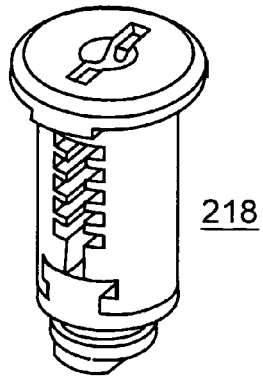
Figure 9:
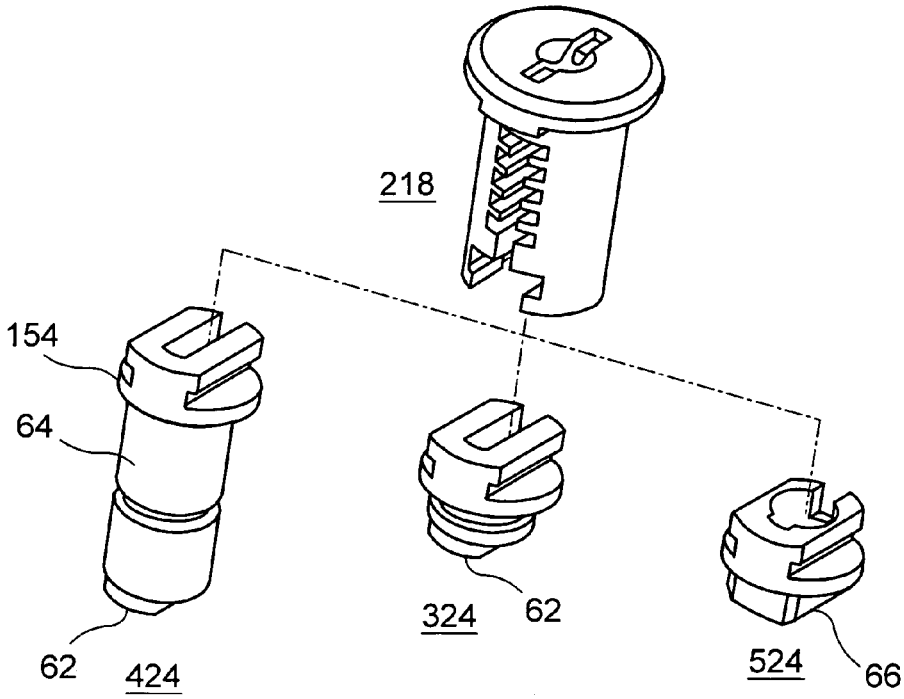
FIG. 9 shows the closing core according to FIGS. 8A to 8C which can be outfitted with differently constructed drive devices.

While there is an outer radial extension (thumb 52, bolt 60) projecting over the circumference of the core in the embodiment forms described above (drives 124 and 224), there is no axial extension in the following embodiment forms where this is not the case. Accordingly, the series of FIGS. 8A, 8B and 8C shows the mounting of a drive 324 at the end of the closing core which does not project out radially over the inner cylindrical space of the enclosing housing. The drive is implemented in this case by means of an eccentric 62 extending away axially from the circular disk. When a longer axial path must be traveled before closure is reached, an embodiment form according to FIG. 9, left, can also be selected in which a shaft 64 extends away axially from the side of the circular disk remote of the core. According to another alternative shown at right in FIG. 9, a polygon such as a square 66 proceeds from the side of the circular disk remote of the core. Since the housing can also enclose the circular disk 154 at the same time, the locking devices such as those described in the embodiment form according to FIG. 4 and which are not necessary in this case are dispensed with.

Figure 10A:
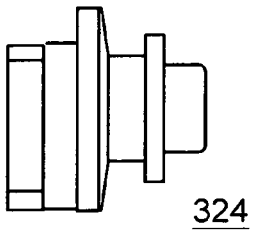
FIGS. 10A, 10B and 10C shows three different views of the drive for an eccentric, shown in the center of FIG. 9.
Figure 10B:
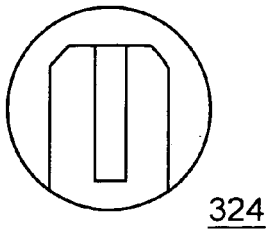
Figure 11A:
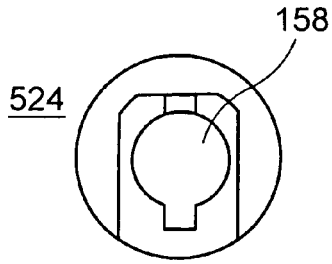
FIGS. 11A and 11B show two views of the drive for a square, shown at right in FIG. 9.
Figure 10C:
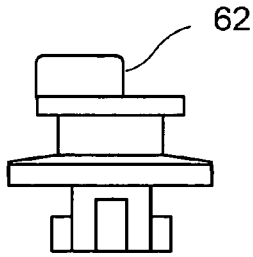
Figure 11B:
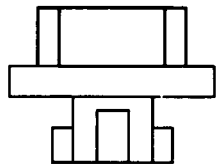
Figure 12A:
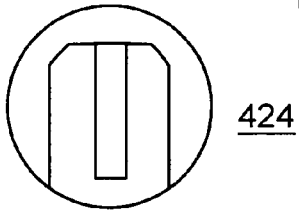
FIGS. 12A and 12B show two views of the drive for a shaft, shown at left in FIG. 9.
Figure 12B:
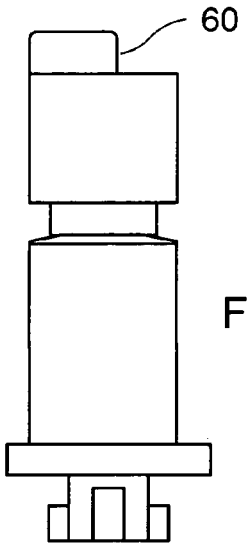

The eccentric drive 324 is shown in three different views in FIGS. 10A, 10B and 10C, the eccentric drive with the shaft extension 424 (in both types of drives the structural component parts are secured by the closure device in a manner which is not relevant in the present case) is shown in two different views in FIGS. 12A and 12B, while the square arrangement 524 is shown in FIGS. 11A and 11B, where a bore hole 158 can also be used again in this case to hold a fastening screw for a bolt according to FIG. 1 which can be mounted on the square.

Figure 13A:
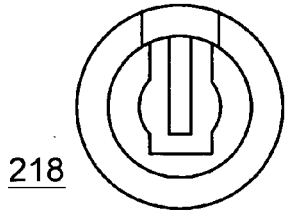
FIGS. 13A and 13B show two different views of the closing core according to FIG. 9.
Figure 13B:
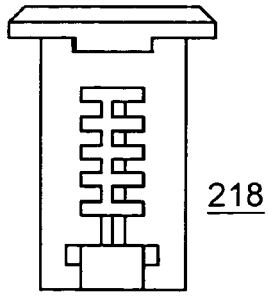
Figure 14A:
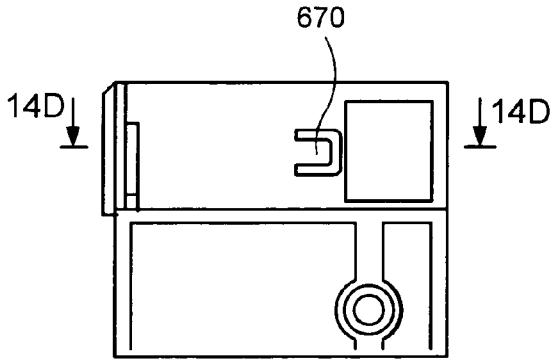
FIGS. 14A, 14B, 14C, 14D and 14E show a side view, a front view, a top view, an axial sectional view along line A—A of FIG. 14A, and a perspective view of a snap profile cylinder with features according to the invention.
Figure 14B:
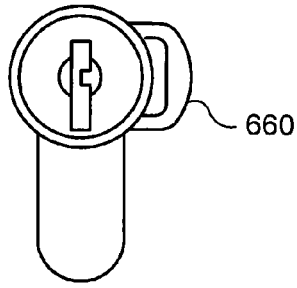
Figure 14D:
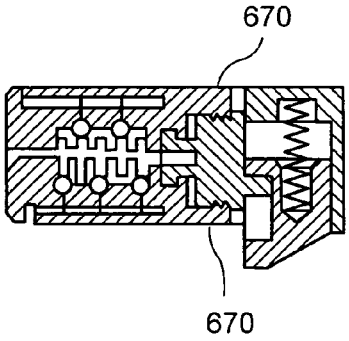
Figure 14C:
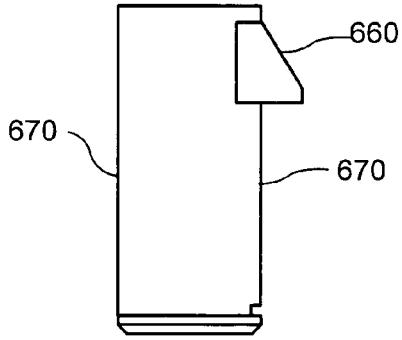
Figure 14E:
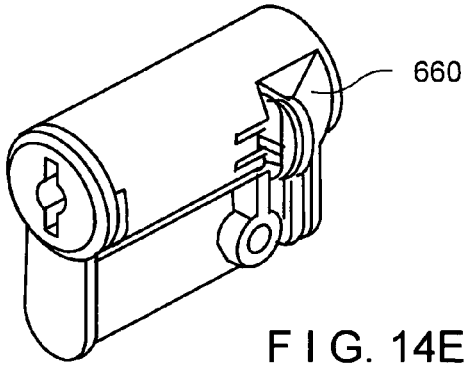

The closing core 218 which is also used in FIGS. 8 and 9 is shown again in FIGS. 13A and 13B in two views.

In the snap profile cylinder shown in FIGS. 14A to 14D, the closing core 618 (see also the enlarged view in FIG. 15) drives a bolt device 624 which in turn communicates via an eccentric 662 with a latch-like bolt 660, which latch is pushed into the closing position by a pressure spring 668 and in this closing position can be displaced automatically out of this closing position during the opening process by the eccentric 662 against the force of this spring 668.

While the profile half-cylinder is preferably made of plastic such as polyamide like the bolt device or adapter 624 according to FIGS. 16A to 16H and the latch 660, the structural component part 618, that is, the closing core, is injection molded from a die casting metal such as a zinc alloy. Because of the flexibility of the plastic material, the closing core 618 can then be fastened to a clip device inside the closing housing 612, which simplifies manufacture and assembly and makes them less expensive. For this purpose, the closing housing 612 can form two oppositely located springs with catch noses 670 which snap into an annular groove 672 formed by the bolt device 624 when the closing core 618 with inserted bolt device 624 is inserted from the front (from the top with reference to FIG. 15) into the closing house 612, wherein the eccentric 662 also penetrates into the receiving space 674 for the latch 660 during the insertion and, through its locking mechanism, also prevents the latch 660 from sliding out due to the force of the spring 668.

Figure 15:
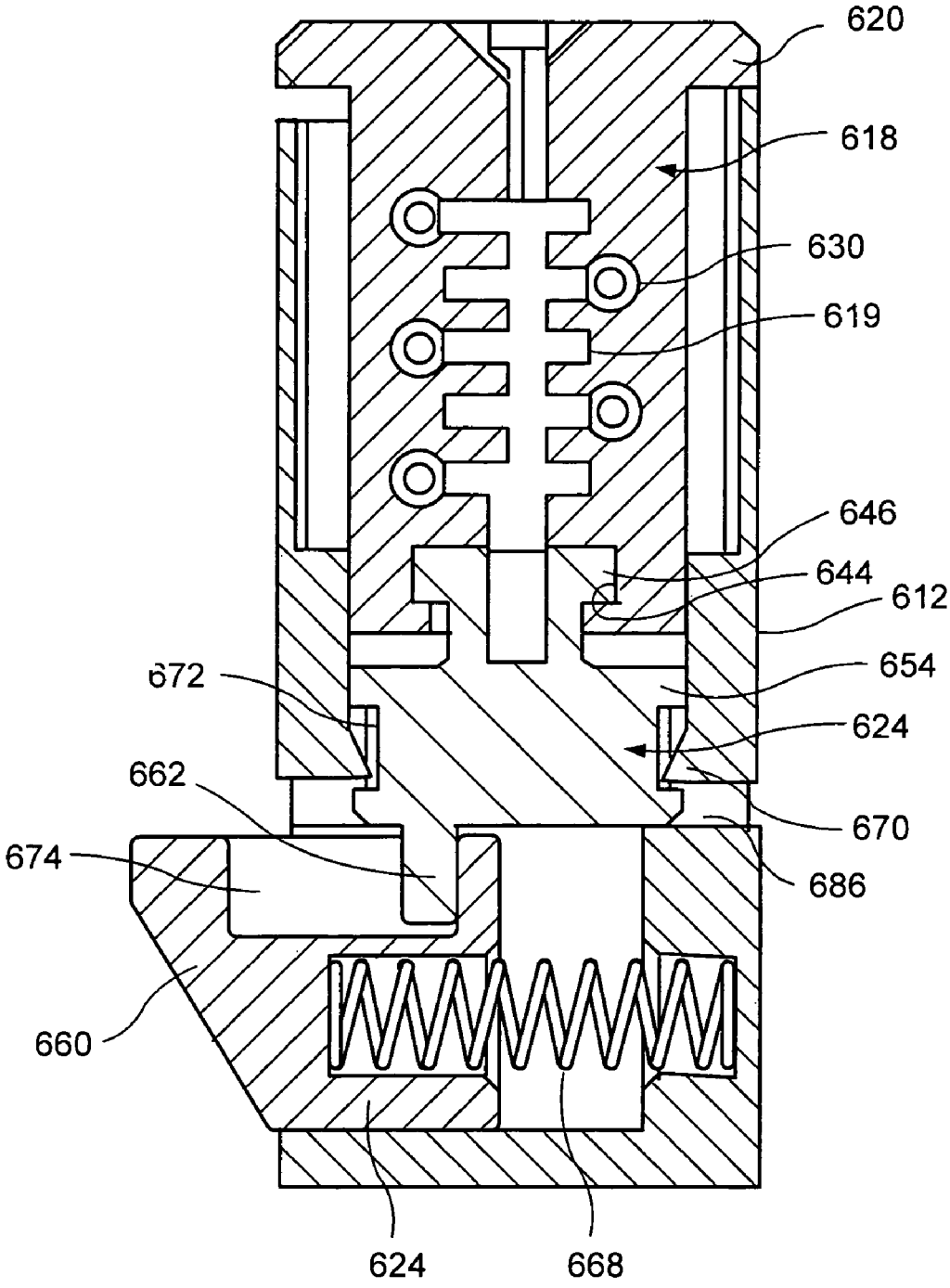
FIG. 15 shows an enlarged view of the snap profile cylinder according to FIG. 14D.
Figure 16B:
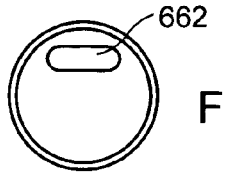
FIGS. 16A, 16B, 16C, 16D, 16E, 16F, 16G and 16H show a side view, a front view, a side view rotated by 90°, a rear view, a sectional view along line A—A of FIG. 16A, a sectional view along line B—B of FIG. 16A, and a perspective view of the coupling piece of the snap profile cylinder according to FIGS. 14A to 14E.
Figure 16A:
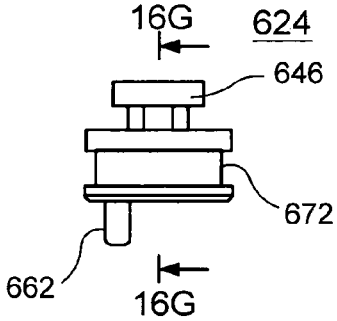
Figure 16D:
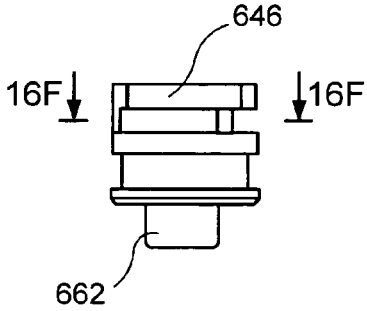
Figure 16C:
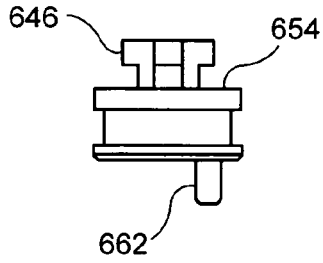
Figure 16E:
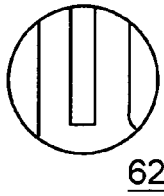
Figure 16F:
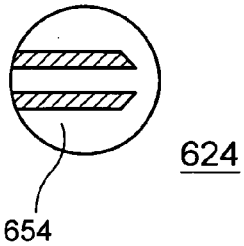
Figure 16G:
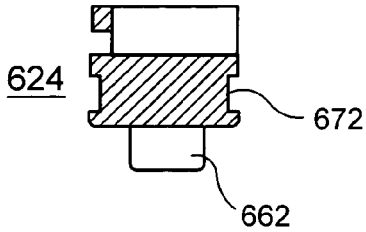
Figure 16H:
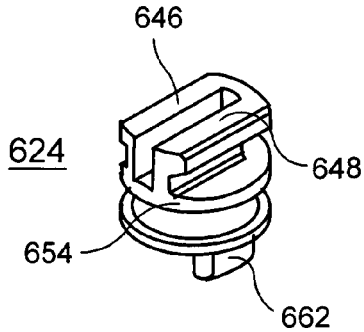
Figure 17:
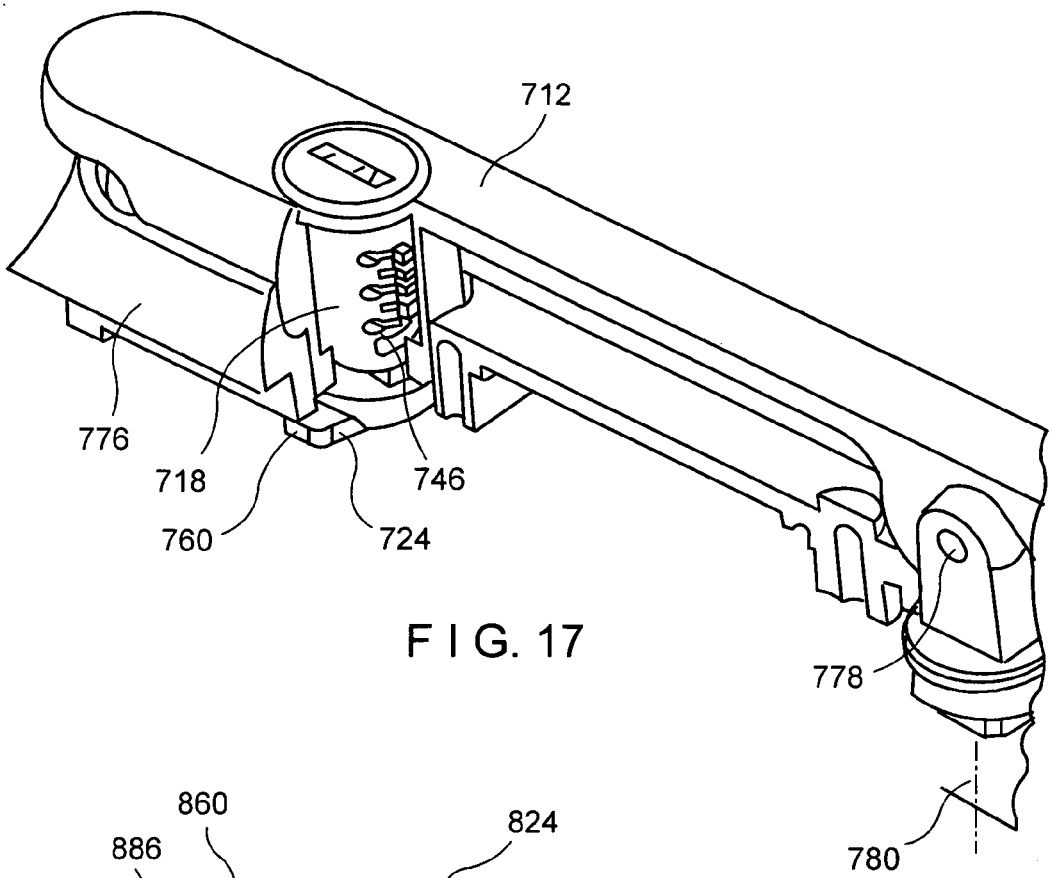
FIG. 17 shows a perspective view of a closing cylinder according to the invention which is inserted into a swivel lever closure.

The housing 612 which is provided according to FIG. 15 and which encloses the closing core 618 can be dispensed with when the closing core is used in closure devices forming a kind of housing for the closing core. Accordingly, FIG. 17 shows a swivel lever closure which comprises a handle 712 that can be swiveled out of a trough 776 about an axis 778 in order subsequently to actuate a rotary closure or the like and in which the lever 712 is swiveled about an axis 780. A closing core 718 which can be inserted in the hand lever 712 forming corresponding housing-like receiving areas for the closing core 718 serves to lock the swivel lever 712 in its position in which it is swiveled into the trough (see the view in FIG. 17). A bolt device 724 with a groove-spring-foot which is insertable into the closing core 746 carries a tongue which engages behind a portion of the trough when the closing core is in a closing position and then holds the hand lever 712 in the trough 776 in a locking manner.

Figure 18A:
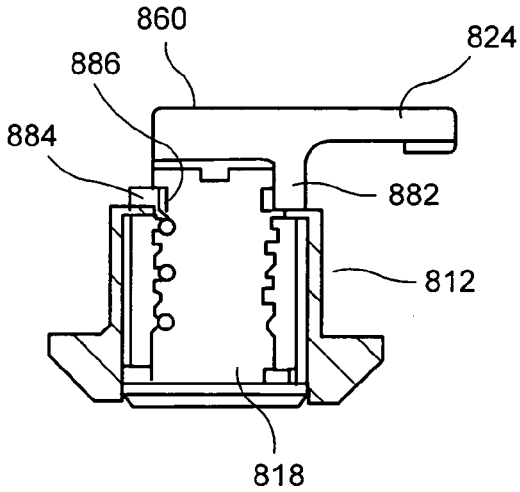
FIGS. 18A and 18B show a sectional side view and a sectional perspective view of a closing cylinder which is designed as a sash closure and is constructed according to the invention.
Figure 18B:
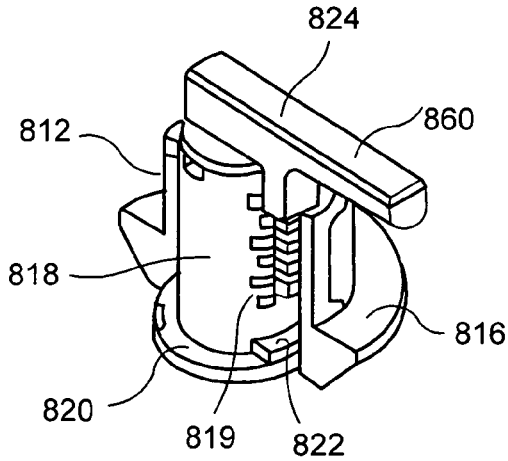

In the closure shown in FIGS. 18A and 18B, a closing core 818 is inserted into a housing 812 from the front (from the bottom referring to the drawings) and then a sash 824, 860 provided with a groove-spring-foot is inserted laterally into the corresponding recess of the closing core 818, from right to left in FIG. 18A. A shoulder 882 of the sash 824, 860 serves as a nose for limiting the rotational path which strikes housing projections 884. Such housing projections 884 can be constructed in a springing manner in housings made of polyamide, so that they secure them in a locking or catching manner in corresponding recesses 886 of the closing core 818.

This recess 886 may be formed similar to the recess 686 shown in FIG. 15.

The invention is commercially available in switching cabinet construction.

While the foregoing description and drawings represent the present invention, it will be obvious to those skilled in the art that various changes may be made therein without departing from the true spirit and scope of the present invention.

What is claimed is:

1. A closing cylinder for closure devices comprising;

a cylindrical closing housing which can be received in a fixed manner in an opening formed by a handle, closure device;

a closing core being rotatably mounted in said closing housing and being axially supported at one of its ends on the edge of the closing housing by an edge projection, wherein the edge projection and the housing edge are able to limit the rotational path; and the closing core carrying a drive at its other end for a bolt or closure;

said drive for a bolt or closure being held at the end of the closing core in a positive engagement so as to be exchangeable;

said closing core extending radially an undercut groove in the end face of the other end; and a tongue which protects from the drive for the bolt or closure and which is positioned into the groove laterally;

wherein the drive includes a circular disk and the tongue proceeds from the circular disk which contacts the end face of the closing core when the tongue is inserted into the groove and a locking device is provided between the end face and the drive for a bolt or closure and locks in when the tongue is inserted into the groove when the work position is achieved.

2. The closing cylinder according to claim 1, wherein the locking device comprises projections and recess which proceed respectively from the end face and from the surface of the circular disk facing this end face.

3. The closing cylinder according to claim 1, wherein a radially projecting thumb device or tongue device proceeds from the side of the circular disk remote of the core.

4. The closing cylinder according to claim 1, wherein an axially projecting eccentrics proceeds from the side of the circular disk remote of the core.

5. The closing cylinder according to claim 1, wherein an axially projecting shaft whose free end forms or carries an eccentric proceeds from the side of the circular disk remote of the core.

6. The closing cylinder according to claim 1, wherein a polygon such as a square proceeds from the side of the circular disk remote of the core.

7. The closing cylinder according to claim 1, wherein the circular disk carrying the tongue has a through-hole for receiving the shaft of a cap screw to be screwed into the closing core.

8. The closing cylinder according to claim 1, wherein the drive is made of electrically insulating plastic.

* * * * *